US007401786B2

(12) United States Patent
Lochtefeld

(10) Patent No.: US 7,401,786 B2
(45) Date of Patent: Jul. 22, 2008

(54) SURF TOY ACTION FIGURE AND SIMULATED SURFING GAME

(75) Inventor: Thomas J. Lochtefeld, La Jolla, CA (US)

(73) Assignee: Light Wave, Ltd., La Jolla, CA (US)

( * ) Notice: Subject to any disclaimer, the term of this patent is extended or adjusted under 35 U.S.C. 154(b) by 0 days.

(21) Appl. No.: 11/633,381

(22) Filed: Dec. 4, 2006

(65) Prior Publication Data

US 2007/0090602 A1 Apr. 26, 2007

Related U.S. Application Data

(63) Continuation of application No. 10/056,893, filed on Jan. 24, 2002, now abandoned.

(60) Provisional application No. 60/263,962, filed on Jan. 24, 2001.

(51) Int. Cl.
*A63F 9/00* (2006.01)

(52) U.S. Cl. ..... 273/441; 273/461; 273/443; 273/456

(58) Field of Classification Search ..... 273/440, 273/441, 449, 457, 459, 461, 443, 456, 108.56, 273/108.57; 446/129, 132, 139, 153, 330, 446/359; 405/79; 472/13, 128, 117; 4/491
See application file for complete search history.

(56) References Cited

U.S. PATENT DOCUMENTS 3,159,400 A * 12/1964 Brass et al. ..... 273/449
3,273,889 A * 9/1966 Brass et al. ..... 273/441
3,926,435 A * 12/1975 Nacci ..... 463/69
4,012,040 A * 3/1977 Fernandes ..... 273/108.56
4,923,427 A * 5/1990 Roland ..... 446/153
4,954,014 A * 9/1990 Sauerbier et al. ..... 405/79
4,963,116 A * 10/1990 Huber ..... 446/176
5,236,280 A * 8/1993 Lochtefeld ..... 405/79
5,401,117 A * 3/1995 Lochtefeld ..... 405/79
5,628,584 A * 5/1997 Lochtefeld ..... 405/79
5,899,633 A * 5/1999 Lochtefeld ..... 405/79
5,947,788 A * 9/1999 Derrah ..... 446/154
6,019,547 A * 2/2000 Hill ..... 405/79
6,132,317 A * 10/2000 Lochtefeld ..... 472/117
6,183,333 B1 * 2/2001 Hall ..... 446/154
6,319,137 B1 * 11/2001 Lochtefeld ..... 472/117
6,336,771 B1 * 1/2002 Hill ..... 405/79
6,491,589 B1 * 12/2002 Lochtefeld ..... 472/117
2002/0072422 A1 * 6/2002 Lochtefeld ..... 472/117
2002/0180155 A1 * 12/2002 Lochtefeld ..... 273/441

* cited by examiner

*Primary Examiner*—Raleigh W. Chiu
(74) *Attorney, Agent, or Firm*—Knobbe, Martens Olson & Bear, LLP

(57) ABSTRACT

The present invention provides a miniature live-action surfing attraction and associated surf game specifically adapted for use with one or more surf toy action figures. The surf toy action figures are mountable to a surf board appropriately sized and weighted to provide relatively stable or semi-stable surf-riding action upon a sheet flow of water flowing up an inclined ride surface of the reduced scale attraction. Various surf action figures may be set free upon the ride surface, or they may be constrained or partially constrained by wires, strings, magnets or the like, as desired. Alternatively, or in addition, they may be controlled via a remote control, or radio control transmitter, as desired. Thus, a fun and entertaining game is created that provides realistic live-action surfing within a relatively small or confined area.

13 Claims, 10 Drawing Sheets

SURF TOY ACTION FIGURE AND SIMULATED SURFING GAME

CROSS-REFERENCE TO RELATED APPLICATIONS

This application is a continuation of U.S. application Ser. No. 10/056,893, which was filed on Jan. 24, 2002 now abandoned, and which claims priority under 35 USC § 119(e) to U.S. provisional application Ser. No. 60/263,962 filed Jan. 24, 2001. The entirety of each of these applications is hereby incorporated by reference.

BACKGROUND OF THE INVENTION

1. Field of the Invention

This invention relates in general to the field of toy action figures and games and, in particular, to a surf toy action figure and associated simulated surfing game for play simulation of a live-action surfing experience.

2. Description of the Related Art

Over the last several decades, surfing and associated wave riding activities, e.g., knee-boarding, body-boarding, skim-boarding, surf-kayaking, inflatable riding, and body surfing (all hereinafter collectively referred to as "wave-riding") have grown in popularity along the world's surf endowed coastal shorelines.

My U.S. Pat. No. 5,236,280, incorporated herein by reference in its entirety, first disclosed the concept of an artificial simulated wave water ride attraction having an inclined ride surface covered with an injected sheet flow of water upon which riders could perform water skimming maneuvers simulative of actual ocean surfing. Sheet flow water rides are currently in widespread use at many water parks and other locations around the world. Such rides allow the creation of an ideal live-action surfing wave experience even in areas that do not have access to beaches or an ocean.

However, live-action water rides are generally expensive to construct and operate and, therefore, are not particularly well suited for very small-scale operations such as local family entertainment centers, arcades or similar venues. For these venues video-simulated surfing games have been used to recreate a surfing-like experience within a compact enclosure or game console. For example, U.S. Pat. No. 4,817,950 discloses a video game in which the game player is able to move a figure of a surfer on a video screen by standing on a simulated surfboard and moving the board with his feet; movements of the board from side to side and forward and backward are translated instantaneously to corresponding movements of the surfboard shown on the video screen, allowing the surfing figure to be maneuvered around obstacles, and up and down waves.

While such video-simulated surfing games are generally well-suited for small scale applications, such as video arcades and the like, they lack the realistic live-action, hydro-dynamic surfing experience of actual ocean surfing.

SUMMARY OF THE INVENTION

The present invention provides a reduced-scale simulated water ride attraction and associated surf game specifically adapted for use with one or more surf toy action figures. The surf toy action figures are preferably each mountable to a surf board appropriately sized and weighted to provide relatively stable or semi-stable surf-riding action upon a sheet flow of water flowing up an inclined ride surface of the reduced scale attraction. Various surf action figures may be set free upon the ride surface, or they may be constrained or partially constrained by wires, strings, magnets or the like, as desired. Alternatively, or in addition, they may be controlled via a remote control, or radio control transmitter, as desired. Thus, a fun and entertaining game is created that provides realistic live-action surfing within a relatively small or confined area.

The game also allows persons who may be physically challenged or who are otherwise unable to participate in open ocean surfing or other simulated surf ride attractions to safely participate in and enjoy a realistic live-action surfing experience. Thus, the subject invention pioneers a whole new realm of miniature live-action surf riding, as yet unexplored by current art. In one embodiment a surf-action game is provided comprising an inclined ride surface having a lower base portion and an upper ridge portion. A nozzle is disposed at or near the base portion and is sized and configured to receive a flow of water from a source and to inject the water as a sheet flow upward onto said ride surface. One or more toy surf-action figures are provided and are adapted to ride and/or perform water skimming maneuvers upon the sheet flow of water. Preferably, the inclined surface is substantially containerless and without side walls so as to provide substantially undisturbed flow without significant oblique wave formation, although sidewall-contained embodiments are also possible.

The nozzle preferably comprises an elongated nozzle extending substantially the width of the ride surface. Optionally, a reservoir may be used to contain a body of water at a desired height and having an opening at the base thereof forming the requisite nozzle. Alternatively, the nozzle may be connected directly to a pressurized water source, such as an ordinary garden hose.

The toy surf action figures preferably comprise miniature molded human figures in various surfing poses. The surf action figures are preferably mounted on a miniature surf board adapted to skim upon the upward sheet water flow. Optionally, the surf board may comprise a control mechanism adapted to enable a play participant to control the location and/or orientation of the surf action figure in relation to the injected sheet flow. The control mechanism preferably comprises a movable weight controlled by a magnet or radio frequency transmitter and receiver/actuator.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiments) disclosed.

BRIEF DESCRIPTION OF THE DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENT

Figure 1:
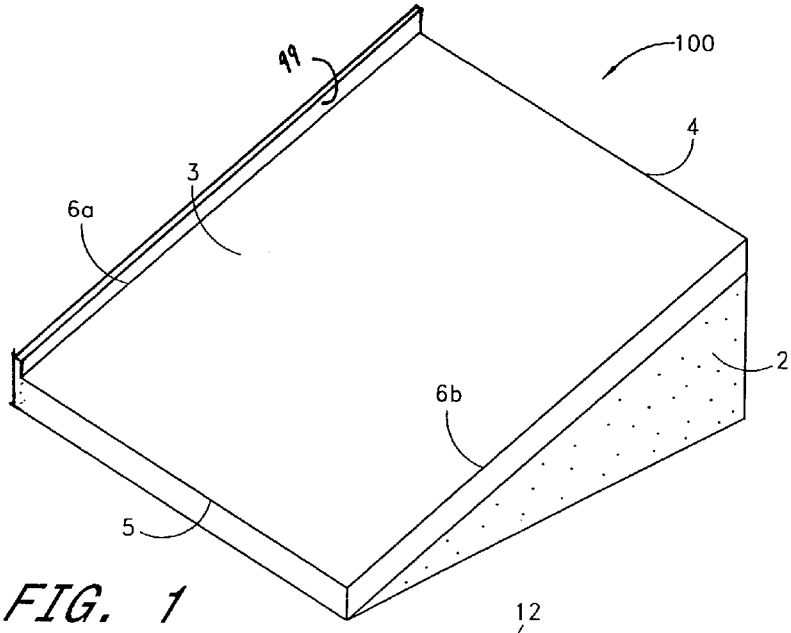
FIG. 1 is a schematic drawing of one embodiment of an inclined ride surface of a simulated surfing game apparatus having features and advantages of the present invention.

To better understand the features and advantages of the invention described herein a detailed explanation of certain terms is provided below. However, it should be pointed out that these explanations are in addition to the ordinary meaning of such terms, and are not intended to be limiting with respect thereto.

A body of water is a volume of water wherein the flow of water comprising that body is constantly changing, and with a shape thereof at least of a length, breadth and depth sufficient to permit water skimming maneuvers thereon as limited or expanded by the respective type of flow, i.e., deep water or sheet flow.

Deep water flow is a flow having sufficient depth such that the pressure disturbance from the rider and his vehicle are not significantly influenced by the presence of the bottom.

Sheet water flow is a flow having a relatively shallow depth such that the pressure disturbance from the rider and his vehicle are substantially influenced by the presence of the bottom according to the well-known hydrodynamic principle of "ground effect."

Water skimming maneuvers are those maneuvers capable of performance on a flowing body of water upon a containerless incline including: riding across the face of the surface of water; riding horizontally or at an angle with the flow of water; riding down a flow of water upon an inclined surface countercurrent to the flow moving up said incline; manipulating the planing body to cut into the surface of water so as to carve an upwardly arcing turn; riding back up along the face of the inclined surface of the body of water and cutting-back so as to return down and across the face of the body of water and the like, e.g., lip bashing, floaters, inverts, aerials, 360's, etc. Water skimming maneuvers can be performed with the human body or upon or with the aid of a riding or planing vehicle such as a surfboard, bodyboard, water ski(s), inflatable, mat, inner tube, kayak, jet-ski, sail boards, etc. In order to perform water skimming maneuvers, the forward force component required to maintain a rider (including any skimming device that he may be riding) in a stable riding position and overcome fluid drag is due to the downslope component of the gravity force created by the constraint of the solid flow forming surface balanced primarily by momentum transfer from the high velocity upward shooting water flow upon said forming surface. A rider's motion upslope (in excess of the kinetic energy added by rider or vehicle) consists of the rider's drag force relative to the upward shooting water flow exceeding the downslope component of gravity. Non-equilibrium riding maneuvers such as turns, cross-slope motion and oscillating between different elevations on the "wave" surface are made possible by the interaction between the respective forces as described above and the use of the rider's kinetic energy.

The equilibrium zone is that portion of a inclined riding surface upon which a rider is in equilibrium on an upwardly inclined body of water that flows thereover; consequently, the upslope flow of momentum as communicated to the rider and his vehicle through hydrodynamic drag is balanced by the downslope component of gravity associated with the weight of the rider and his vehicle.

The supra-equidyne area is that portion of a riding surface contiguous with but downstream (upslope) of the equilibrium zone wherein the slope of the incline is sufficiently steep to enable a water skimming rider to overcome the drag force associated with the upwardly sheeting water flow and slide downwardly thereupon.

The sub-equidyne area is that portion of a riding surface contiguous with but upstream (downslope) of the equilibrium zone wherein the slope of the incline is insufficiently steep to enable a water skimming rider to overcome the drag force associated with the upwardly sheeting water flow and stay in equilibrium thereon. Due to fluid drag, a rider will eventually move in the direction of flow back up the incline.

The Froude number is a mathematical expression that describes the ratio of the velocity of the flow to the phase speed of the longest possible waves that can exist in a given depth without being destroyed by breaking. The Froude number equals the flow speed divided by the square root of the product of the acceleration of gravity and the depth of the water. The Froude number squared is a ratio between the kinetic energy of the flow and its potential energy, i.e., the Froude number squared equals the flow speed squared divided by the product of the acceleration of gravity and the water depth.

Subcritical flow can be generally described as a slow/thick water flow. Specifically, subcritical flows have a Froude number that is less than 1, and the kinetic energy of the flow is less than its gravitational potential energy. If a stationary wave is in a sub-critical flow, then, it will be a non-breaking stationary wave. In formula notation, a flow is subcritical when v<square root gd where v=flow velocity in ft/sec, g=acceleration due to gravity ft/sec$^2$, d=depth (in feet) of the sheeting body of water.

Critical flow is evidenced by wave breaking. Critical flow is where the flow's kinetic energy and gravitational potential energy are equal. Critical flow has the characteristic physical feature of the hydraulic jump itself. Because of the unstable nature of wave breaking, critical flow is difficult to maintain in an absolutely stationary state in a moving stream of water given that the speed of the wave must match the velocity of the stream to remain stationary. This is a delicate balancing act. There is a match for these exact conditions at only one point for one particular flow speed and depth. Critical flows have a Froude number equal to one. In formula notation, a flow is critical when v=square root gd where v=flow velocity, g=acceleration due to gravity ft/sec$^2$, d=depth of the sheeting body of water.

Supercritical flow can be generally described as a thin/fast flow. Specifically, supercritical flows have a Froude number greater than 1, and the kinetic energy of the flow is greater than its gravitational potential energy. No stationary waves are involved. The reason for the lack of waves is that neither breaking nor non breaking waves can keep up with the flow speed because the maximum possible speed for any wave is the square root of the product of the acceleration of gravity times the water depth. Consequently, any waves which might form are quickly swept downstream. In formula notation, a flow is supercritical when v>square root gd where v=flow velocity in ft/sec, g=acceleration due to gravity ft/sec$^2$, d=depth (in feet) of the sheeting body of water.

The hydraulic jump is the point of wave-breaking of the fastest waves that can exist at a given depth of water. The hydraulic jump itself is actually the break point of that wave. The breaking phenomenon results from a local convergence of energy. Any waves that appear upstream of the hydraulic jump in the supercritical area are unable to keep up with the flow, consequently they are swept downstream until they meet the area where the hydraulic jump occurs; now the flow is suddenly thicker and now the waves can suddenly travel faster. Concurrently, the down stream waves that can travel faster than the flow move upstream and meet at the hydraulic jump. Thus, the convergence of waves at this flux point leads to wave breaking. In terms of energy, the hydraulic jump is an energy transition point where energy of the flow abruptly changes from kinetic to potential. A hydraulic jump occurs when the Froude number is 1.

A stationary wave is a progressive wave that is travelling against the current and has a phase speed that exactly matches the speed of the current, thus, allowing the wave to appear stationary.

White water occurs due to wave breaking at the leading edge of the hydraulic jump where the flow transitions from critical to sub-critical. In the flow environment, remnant turbulence and air bubbles from wave breaking are merely swept downstream through the sub-critical area, and dissipate within a distance of 7 jump heights behind the hydraulic lump.

Separation is the point of zero wall friction whereas the sheet flow breaks away from the wall of the incline or other form or shape placed thereon. Flow separation results from differential losses of kinetic energy through the depth of the sheet flow. As the sheet flow proceeds up the incline it begins to decelerate, trading kinetic energy for gravitational potential energy. The portion of the sheet flow that is directly adjacent to the walls of the incline (the boundary layers) also suffer additional kinetic energy loss to wall friction. These additional friction losses cause the boundary layer to run out of kinetic energy and come to rest in a state of zero wall friction while the outer portion of the sheet flow still has residual kinetic energy left. At this point the outer portion of the sheet flow breaks away from the wall of the incline (separation) and continues on a ballistic trajectory with its remaining energy forming either a spill down or curl over back upon the upcoming flow.

The boundary layer is a region of retarded flow directly adjacent to a wall due to friction.

The separating streamline is the path taken by the outer portion of the sheet flow which does not come to rest under the influence of frictional effects, but breaks away from the wall surface at the point of separation.

Flow partitioning is the lateral division of flows having different hydraulic states.

A dividing streamline is the streamline defining the position of flow partitioning. The surface along which flows divide laterally between super critical and critical hydraulic states.

A bore is a progressive hydraulic jump which can appear stationary in a current when the bore speed is equal and opposite to the current.

A velocity gradient is a change in velocity with distance.

A pressure gradient is a change in pressure with distance.

Conforming flow occurs where the angle of incidence of the entire depth range of a body of water is (at a particular point relative to the inclined flow forming surface over which it flows) predominantly tangential to this surface. Consequently, water which flows upon an inclined surface can conform to gradual changes in inclination, e.g., curves, without causing the flow to separate. As a consequence of flow conformity, the downstream termination of an inclined surface will always physically direct and point the flow in a direction aligned with the downstream termination surface. The change in direction of a conforming flow can exceed 180 degrees.

FIG. 1 is a schematic drawing of one embodiment of an inclined ride surface 3 of a miniature simulated surfing game apparatus 100 having features and advantages of the present invention. Plan-sectional lines as revealed in FIG. 1 are solely for the purpose of indicating the three-dimensional shape in general, rather than being illustrative of specific frame, plan, and profile sections. In fact, it should be noted that a wide variety of dimensions and configurations for a containerless incline 4 are compatible with the principles of the present invention. Therefore, these principles should-not be construed to be limited to any particular configuration illustrated in the drawings or described herein.

The surfing game apparatus 100 generally comprises sub-surface structural support 2, and ride surface 3 which is bounded by a downstream ridge edge (line) 4, an upstream edge 5, and side edges 6*a* and 6*b*. Ride surface 3 can be a skin over sub-surface structural support 2, or can be integrated therewith so long as sufficiently smooth. If a skin, ride surface 3 can be fabricated of any of several of well known materials e.g., plastic; foam; thin shell concrete; formed metal; treated wood; fiberglass; tile; reinforced tension fabric; air, foam or water filled plastic or fabric bladders; or any such materials which are sufficiently smooth to minimize friction loss and which will withstand the surface loads involved.

Sub-surface structural support 2 can be sand/gravel/rock/plaster/fiberglass/plastic; truss and beam; compacted fill; tension pole; or any other well known method for firmly grounding and structurally supporting ride surface 3 in anticipation of flowing water and ride action figures thereon. The inclined shape of ride surface 3 need not be limited to the sloping inclined plane as illustrated in FIG. 1. Ride surface 3 can gradually vary in curvature to assist in smooth water flow. For example, ride surface 3 can observe: upward concavity in longitudinal section parallel to the direction of water flow; or a longitudinal section comprised of upward concavity transitioning to an upward convexity; or a combination of straight, concave and convex longitudinal sections. Illustrations of several curved surface shapes are presented in succeeding figures.

Although numerous shapes are possible, one element constant to all preferred embodiments is that there is an inclined portion of sufficient length, width and degree of angle to enable a rider action-figure to perform water skimming maneuvers. At a minimum such angle is approximately seven degrees from the horizontal. Steeper angles of incline (with portions having a curvature extending past a 90 degree vertical) can provide more advanced ride characteristics and flow phenomena, to be discussed. At a minimum the length (from upstream edge 5 to downstream ridge edge 4) and width (from side edge 6*a* to side edge 6*b*) of incline 1 is preferably greater than the respective length and width of the intended ride vehicle or body. The maximum dimensions of containerless incline 1 are capable of a broad range of values which depend more upon external factors, e.g., site constraints, financial resource, availability of water flow, etc, rather than specific restrictions on the structure itself.

In one case, a containerless incline having an angle of 20 degrees with respect to the horizontal was found to be suitable, to achieve the purposes of the present invention, when a flow of water having a depth of ⅛-1/16 inches and a flow rate of 5-11 feet per second was flowing thereover. The length and width of such incline was approximately 10 inches by 20 inches, respectively. This corresponds to a scale wave surface of roughly 1:24 (½"=1'). Alternatively, smaller or larger scale wave surfaces may be created as desired. For example, it is anticipated that suitable miniature wave surfaces may be created in scales ranging form about 1:48 (¼=1') to about 1:12 (1"=1'). Correspondingly scaled surface action figures would preferably be provided for each such miniature surfing game. Of course, smaller or larger surfaces are also possible depending upon design preferences and costs.

Using such miniature live action surfing apparatus 100 an artificial miniature surfing wave can be generated having an unbroken yet rideable wave face comprising a smooth inclined mound of water having sufficient incline such that the gravity force component tangential to the wave surface balances and/or exceeds the counter-acting forces of drag acting on a miniature surf board. In this manner, sustained live-action riding may be achieved and water skimming maneuvers (e.g., action figure surfing) may be performed and vicariously enjoyed by the game participants. Breaking waves can also be generated having one portion that is broken or breaking and another portion that has a smooth surface, the transition from the smooth to the broken part of the wave occurring continuously over a region spanning a few wave heights and having a surfable transition area. The transition area is of particular interest to the wave-rider. The transition area is where the wave-rider performs optimum water skimming (e.g., surfing) maneuvers. The transition area is also where the wave face reaches its maximum angle of steepness.

Preferably the flow of water over the ride surface comprises a relatively thin sheet flow of high-velocity water. A sheet flow is where the water depth is sufficiently shallow such that the pressure disturbance caused by a rider/action-figure and his vehicle is influenced by the riding surface through a reaction force, whose effects on the rider and his vehicle are generally known as the "ground effect." This provides for an inherently more stable ride, thus requiring less skill to catch and ride the wave.

In the sheet flow situation, the board is so close to a solid boundary, i.e., the flow bed or riding surface, that the pressure disturbance form the board does not have time to diminish before it comes in contact with the solid boundary. This results in the pressure disturbance transmitting through the fluid and directly to the ground. This allows the ground to participate, as a reaction wall, against the weight of the planing-vehicle (and optional action figure) and helps to support the vehicle by virtue of the ground effect. Thus, sheet flows are inherently more stable than deeper water flows. From the perspective of an accomplished user, the ground effect principal offers improved performance in the form of more responsive turns, increased speed, and tighter radius maneuvers resulting from lift augmentation that enables a decrease in vehicle planing area.

Sheet flows also can provide a conforming flow in the sense that the flow generally follows the contours of the riding surface. Therefore, this enables one to better control the shaping of the waves as they conform to the riding surface, while still achieving wave special effects when insufficient velocity at the boundary layer allows for flow separation from the contoured flow bed.

In this regard, it should be pointed out that, with a sheet flow up a containerless incline, no wave (in a technical sense) is necessarily required in order to enjoy a water attraction constructed in accordance with the principals of the present invention. All that is required is an incline of sufficient angle to allow the ride action figure to slide down the upwardly sheeting flow. Furthermore, intentionally induced drag can slow the action figure and send it back up the incline to permit additional maneuvers. Likewise, if desired, the ride action figure can be operated in a state of equilibrium (e.g., a stationary position with respect to the flow) by regulating drag relative to the uphill water flow.

Figure 2:
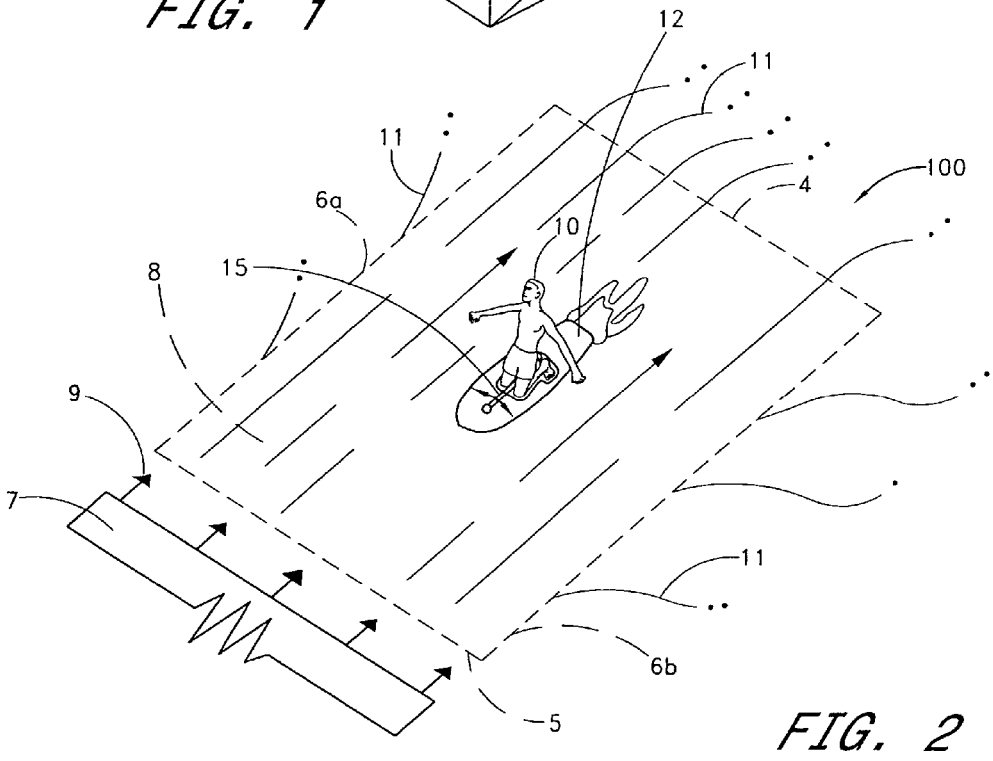
FIG. 2 is a schematic drawing of a surf toy action figure riding on a sheet flow of water flowing upward upon the inclined ride surface of FIG. 1.

FIG. 2 shows containerless incline 100 of FIG. 1 in operation. The basic operation of this device requires a suitable flow source 7 (e.g., pump, hose or elevated reservoir) forming a supercritical sheet flow of water 8 in predominately singular flow direction 9 (as indicated by arrows) over ride surface 3 (whose lateral edges 6 and downstream ridge edge 4 are shown in dashed lines) to form an inclined body of water upon which a rider 10 performs water skimming maneuvers. A small recirculation pump is preferably used to achieve the desired flow of water upward over the ride surface 3.

The orientation and ride path of rider action FIG. 10 may be controlled through a balance of forces, e.g., gravity, drag, hydrodynamic lift, buoyancy, and induced kinetic motion. Gravitational forces pull downward upon the ride action figure tending to drive it down the inclined ride surface 3. Simultaneously, hydraulic drag forces tends to push the ride action FIG. 10 higher up the ride surface. Non-equilibrium riding maneuvers such as turns, cross-slope motion and oscillating between different elevations on the "wave-like" surface are made possible by the interaction between the respective forces as described above and the use of kinetic energy of the ride action figure.

There is no maximum depth for supercritical flow 8, although shallow flows are preferred with a practical minimum of approximately 1/16". The preferred relation of flow depth to flow speed can be expressed in terms of a preferred Froude number. A practical regime of Froude numbers for containerless incline 1 is from 2 through 75, with the preferred range between 4 and 25 for the entire sheet. Flows with Froude numbers greater than 1 and less than 2 are prone to contamination from pulsating motions known as "roll waves" which are actually vortices rather than waves. Sheet water flows are preferred because shallow flows upon a containerless incline 1 will: (a) increase vehicle stability and reduce capsizing or sinking of vehicles in a deep water flow; (b) reduce water maintenance due to decrease in volume of water treated; (c) reduce energy costs by minimizing the amount of pumped water; (d) reduce the requisite skill level of participants as the result of improved ride stability due to "ground effects"; and (e) improved ride performance (i.e., lift and speed) due to ground effects.

Of particular note is how containerless incline 1 will permit water run-off 11 (as indicated by downward curving lines with dotted ends), to cascade from side edges 6 and over downstream ridge edge 4. As noted above, the "containerless" feature of the present invention is important in achieving the desired sheet flow characteristics. Essentially, the lack of lateral container walls permits an unbounded flow of water up the inclined riding surface 3. So long as the stream lines of the water are coherent and substantially parallel to one another and to the lateral edges 6*a* and 6*b* of the riding surface 3, the integrity (i.e., velocity and smooth surface flow characteristics) of the sheeting water flow is maintained. Consequently, a flow which is not side restrained advantageously avoids lateral boundary layer of effects and permits side water run-off, thus, maintaining a smooth flow and unimpaired velocity across the entire sheet of water. Furthermore, as pointed out above, the principles of the present invention apply equally well to an incline surface of various configurations, not necessarily with parallel sides 6*a* and 6*b*. Conversely, a side container wall creates a boundary layer effect which increases the static pressure of the water in the area of the container side wall, decreases the velocity of the sheet flow, and results in a disturbed surface flow. With a container or side wall, such boundary layer effect and disturbance is inevitable due to friction forces and the resultant propagation of oblique waves, both of which make difficult the maintenance of desirable parallel and coherent water streamlines. However, that is not to say that the invention cannot be practiced using an incline with side walls. Such an embodiment will function for the intended purpose, however, it will have some boundary-layer-induced flow disturbances.

Preferably, the propagation of oblique waves and other turbulent flow is eliminated by either eliminating side walls and/or by maintaining a low static pressure along the lateral edges of the sheet flow. On the other hand, it should be noted that the disadvantages of the boundary layer effect are greatly minimized when the sheet flow is on a downwardly inclined surface. This is because turbulence is less likely to be propagated upstream against the force of gravity. Furthermore, any surface disturbance that may form is more likely to be swept downstream by the greater kinetic energy of the main flow of water when compared to that of the turbulent flow, such kinetic energy resulting from the gravity component of the downward flow.

Moreover, by extending ride surface 3, increasing or decreasing its elevation, adding to its surface area, warping its contour, adding horizontal and declining surfaces and/or by changing the direction, speed and thickness of entering supercritical water flow 8, the diverse sheet flow attractions as herein described will result.

Figure 3:
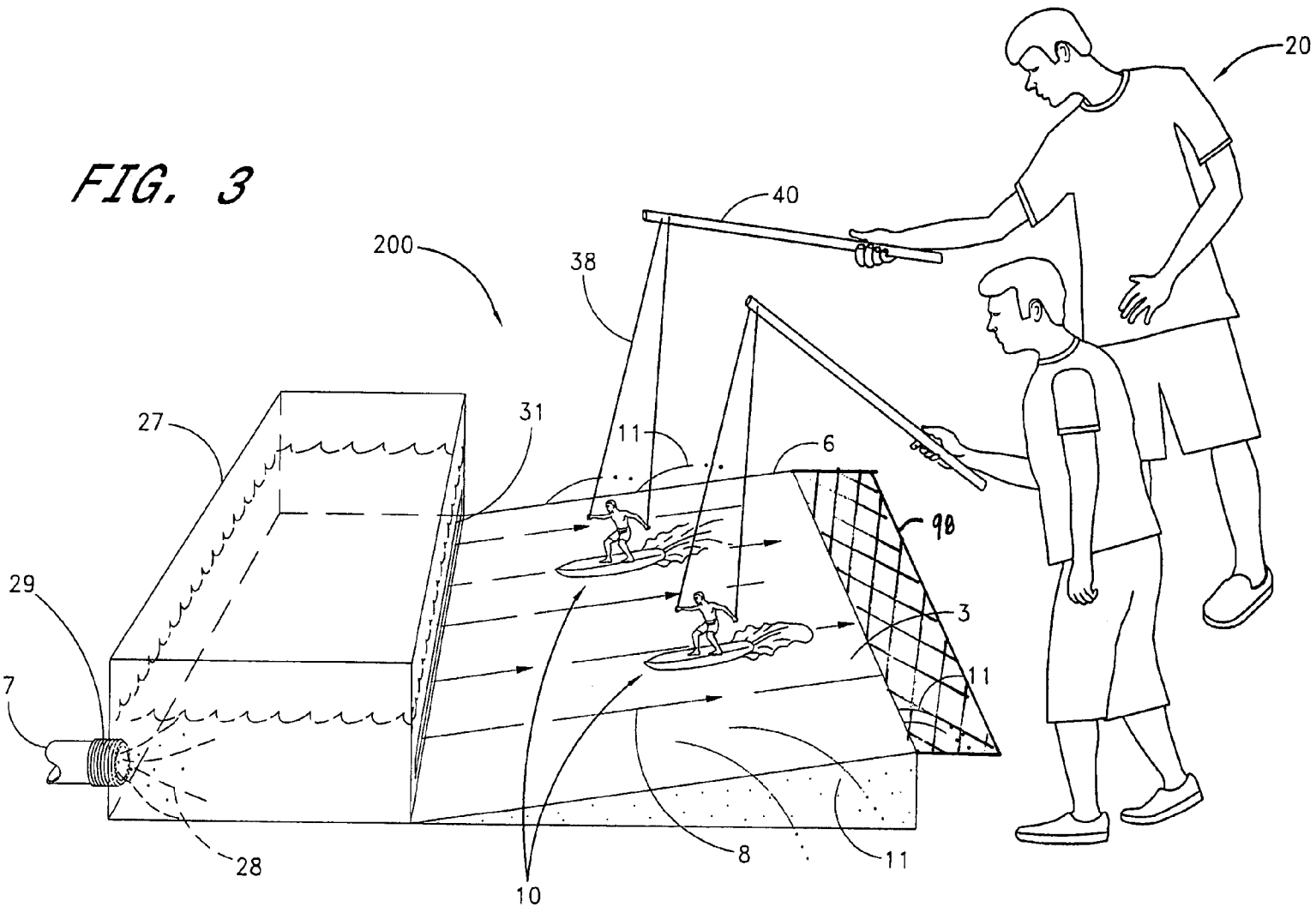
FIG. 3 is a perspective view of marionette-style simulated surfing game apparatus having features and advantages of the present invention.

FIG. 3 is a perspective view of a marionette-style simulated surfing game apparatus having features and advantages of the present invention. For brevity of description and ease of understanding, similar features are denoted using similar and/or identical reference numerals. Multiple variations of the same or similar features may also be denoted using the same reference numerals and the structures thereof are as fairly illustrated and described. Optional reservoir 27 is provided for containing a static body of water and providing an injected sheet flow 8 upon ride surface 3 via nozzle 31. The depth of water in reservoir 27 is preferably adjusted by adding water from a source 7 until a desired amount of head or pressure is achieved at the nozzle 31.

Surf action figures 10 are of a marionette style and are suspending on or above the ride surface using one or more strings 38 (1, 2, 4 ,etc.) as illustrated. A suitable pole, stick or wire 40 may be used by each play participant 20 to control the relative orientation and position of each play action figure and its interaction with the sheet water flow on the ride surface 3. An optional grate/net 98 may also be provided to catch action figures 10 that wipe out or get swept up in the flow 8.

Figure 4A:
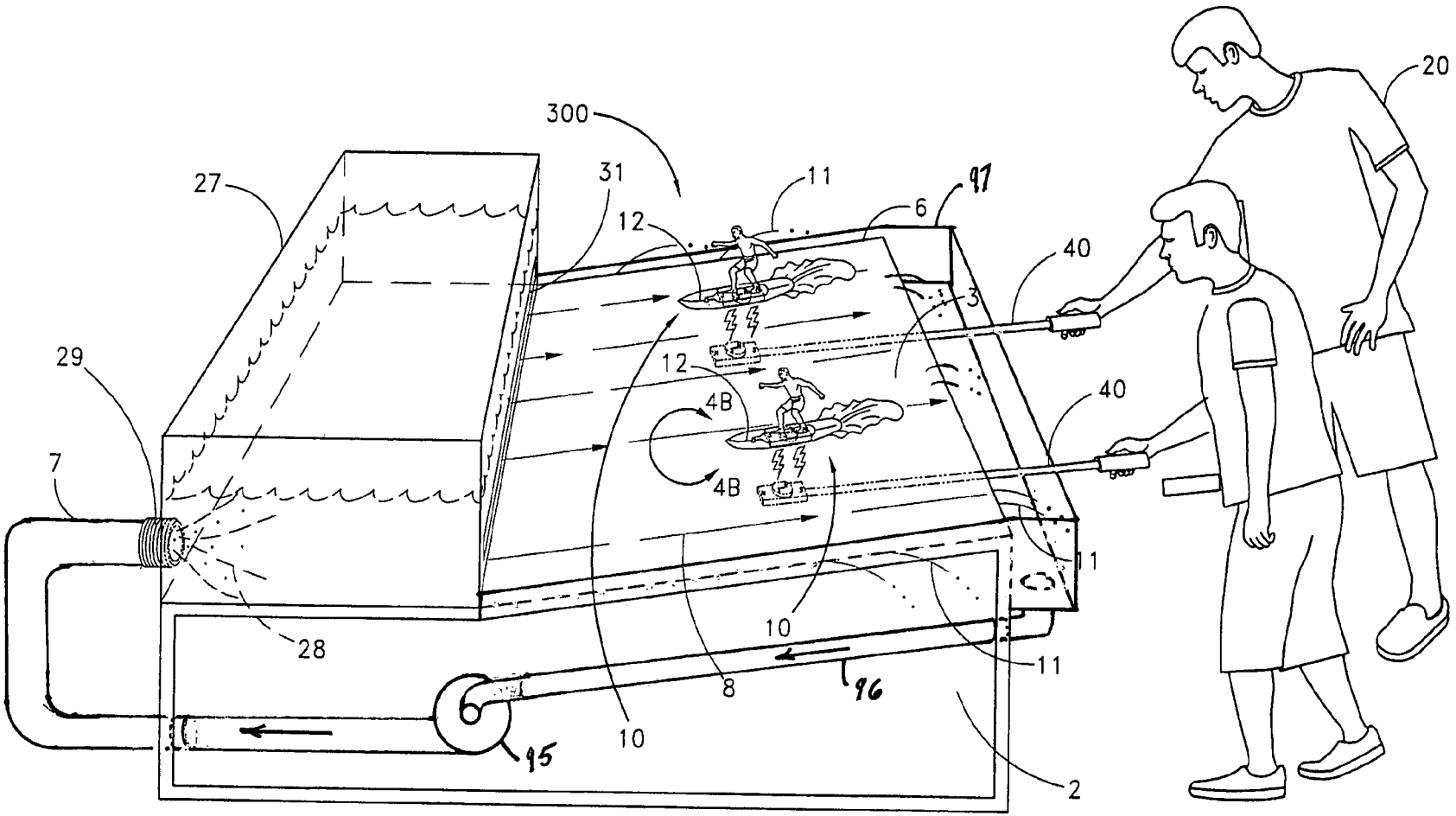
FIG. 4A is a perspective view of a magnetically operated simulated surfing game apparatus having features and advantages of the present invention.

FIG. 4A is a perspective view of a magnetically operated simulated surfing game apparatus having features and advantages of the present invention. For brevity of description and ease of understanding, similar features are denoted using similar and/or identical reference numerals. Multiple variations of the same or similar features may also be denoted using the same reference numerals and the structures thereof are as fairly illustrated and described. Optional elevated support structure 2 is provided for supporting the ride surface 3 at an elevation above ground level.

Figure 4B:
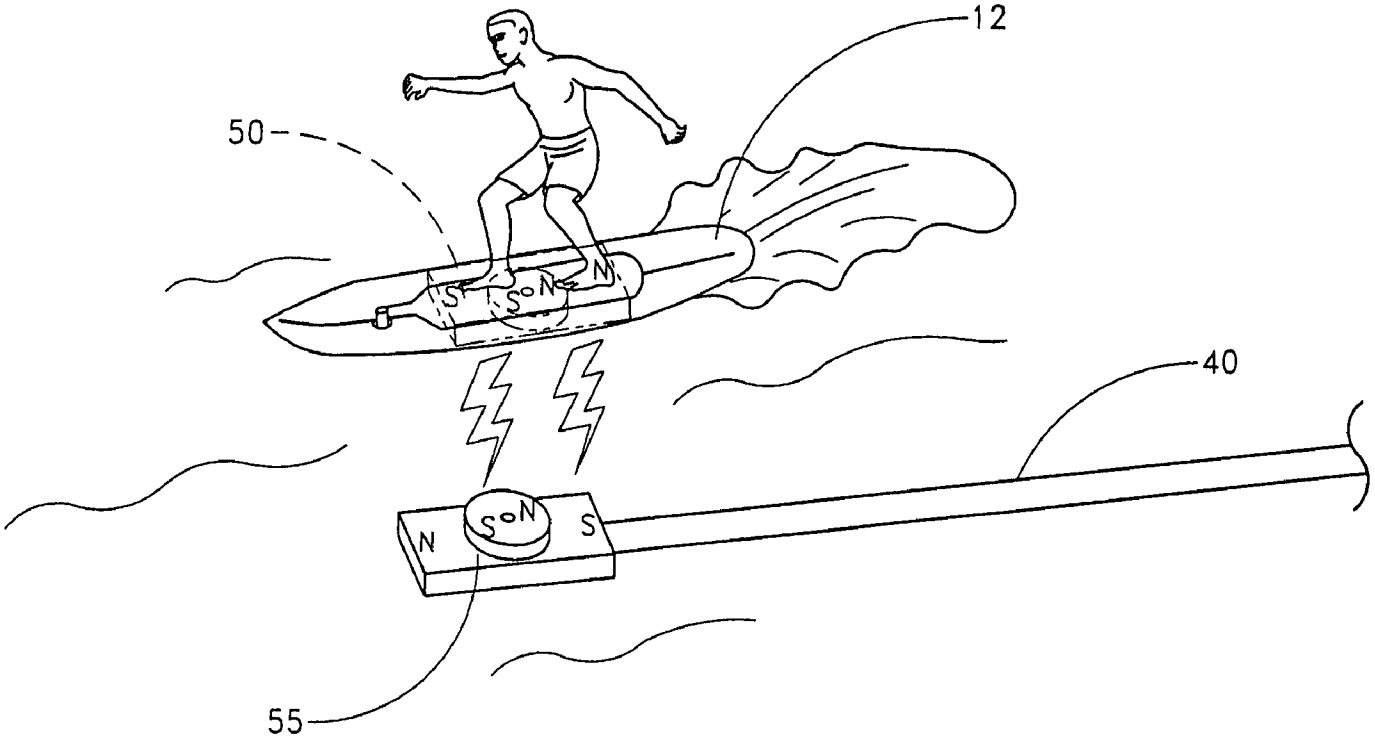
FIG. 4B is a detail view of one embodiment of a magnetically operated surf toy action figure and associated actuator for use with the simulated surfing game apparatus of FIG. 4A.

Magnetically actuated surf action FIG. 10 are provided on the ride surface 3 and are controlled by play participants 20 using one or more magnets disposed underneath the ride surface 3. In particular, the support structure has one or more openings therein (not shown) into which may be inserted an elongated pole or stick having affixed thereto a permanent or electric magnet. The magnetic forces created thereby are caused to interact with a similarly sized and configured magnet at the base of each surf action figure. In this manner, the stick 40 may be used by each play participant 20 to control the relative orientation and position of each play action figure and its interaction with the sheet water flow on the ride surface 3. FIG. 4B is a detail view of a magnetically operated surf toy action figure and associated actuator for use with the simulated surfing game apparatus of FIG. 4A. Optionally, a containment/recirculation system may be provided as illustrated in FIG. 4. In this optional embodiment, water flow 8 is contained by side walls 99 which funnel spent flow 8 into a recovery pool 97. This water is then drawn through a conduit 96 and recirculated by a pump 95.

Figure 5:
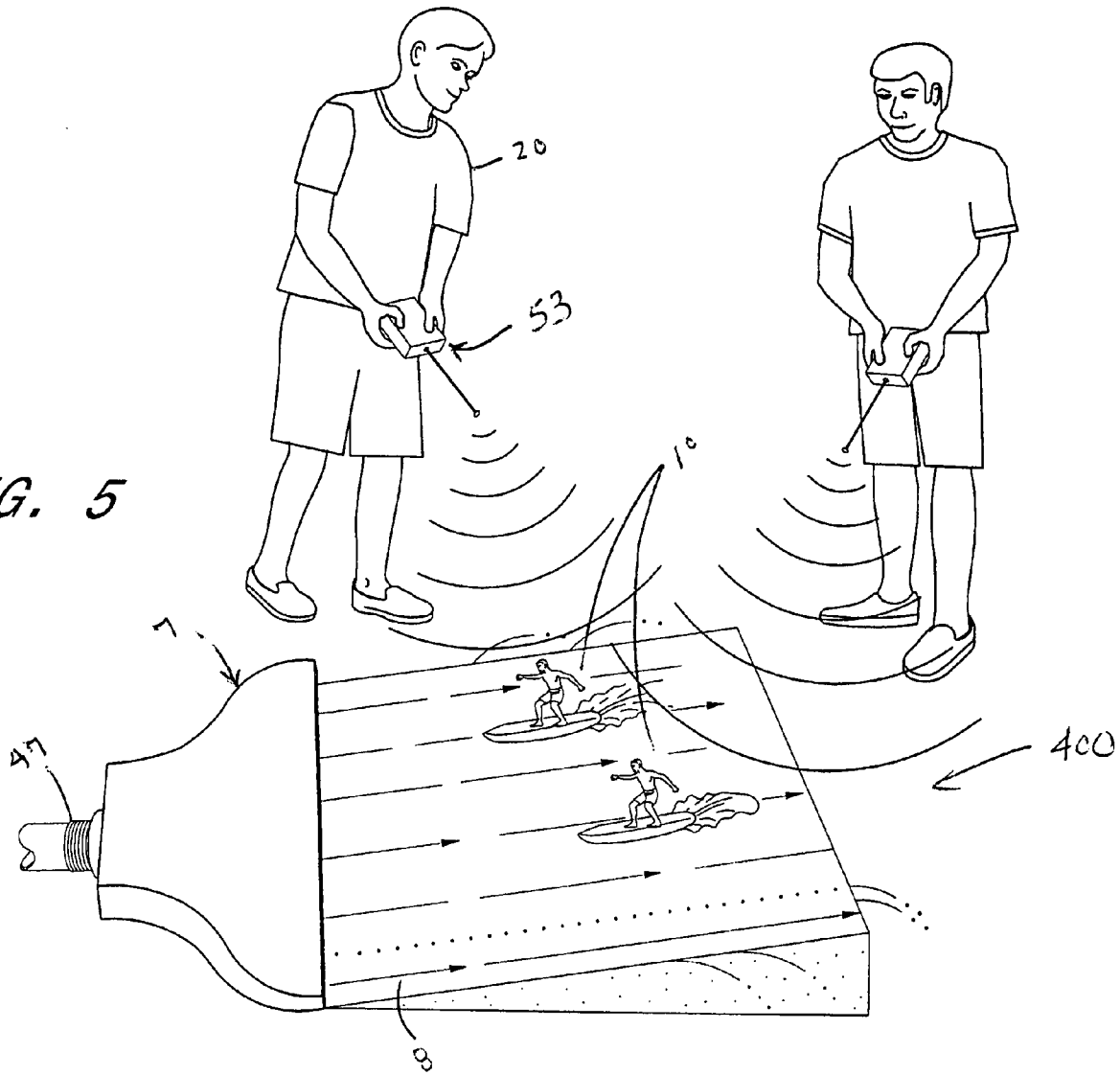
FIG. 5 is a perspective view of a radio remote controlled simulated surfing game apparatus having features and advantages of the present invention.

FIG. 5 is a perspective view of a radio remote controlled simulated surfing game apparatus having features and advantages of the present invention. For brevity of description and ease of understanding, similar features are denoted using similar and/or identical reference numerals. Multiple variations of the same or similar features may also be denoted using the same reference numerals and the structures thereof are as fairly illustrated and described. In this case, sheet water flow 8 is provided upon ride surface 3 by a water source 7 configured in the form of an elongated nozzle connected to a pressurized water source 47, such as an ordinary garden hose. The speed and depth of the sheet water flow can thus be adjusted by adjusting the water pressure provided by the garden hose 47 or other source.

Surf action FIG. 10 are preferably constructed so as to be capable of being controlled using radio frequency broadcasts from a transmitter 53 or similar "wireless" communications device as are well-known in the art. In particular, each action FIG. 10 includes a receiver and at least one actuator for causing one or more desired maneuvers, such as weight shifting, rudder and/or drag control, leaning, etc. The radio control may be of conventional design, such as of the type used for other radio-controlled model vehicles and aircraft. In one embodiment disclosed herein, the steering control is a three-position control, straight ahead, left turn and right turn. However, if desired, proportional control of the turning may readily be provided, as is well known in the art. In this manner each play participant 20 can control the relative orientation and position of each play action figure and its interaction with the sheet water flow on the ride surface 3.

Figure 6A:
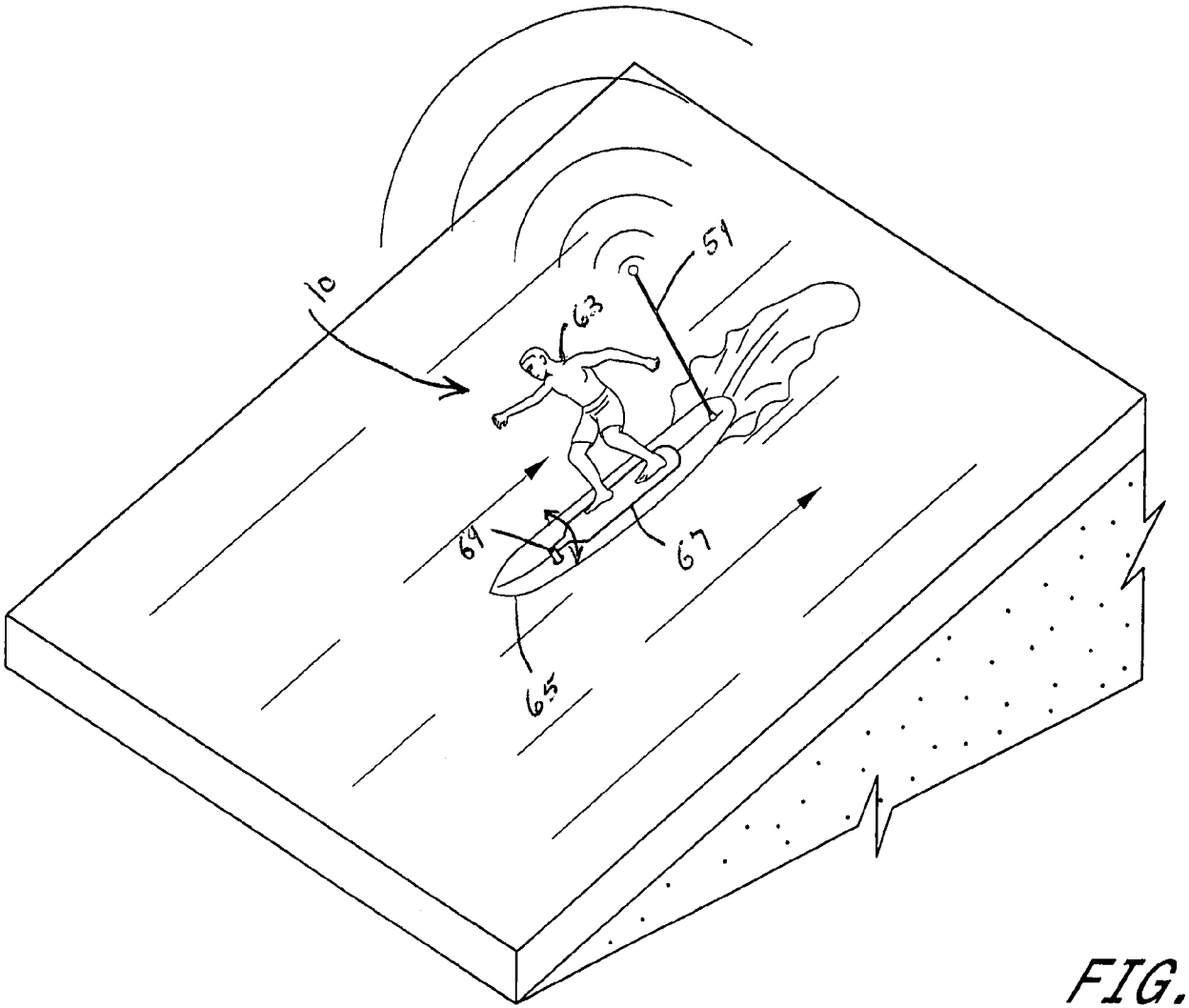
FIG. 6A is a detail view of one embodiment of a radio remote controlled surf toy action figure for use with the simulated surfing game apparatus of FIG. 5.

FIG. 6A is a detail view of one embodiment of a radio remote controlled surf toy action FIG. 10 for use with the simulated surfing game apparatus of FIG. 5. The surf action FIG. 10 generally comprises a plastic molded toy action FIG. 63 pivotally mounted to a miniature surf board or other sheet flow riding vehicle 65. The action FIG. 63 is preferably mounted on a base 67 which is pivotally mounted to the board 65 at pin 69. Pin 69 is preferably rotatable clockwise and/or counter-clockwise directions in response to a radio frequency broadcast or other wireless communications protocol received by antenna 59.

Figure 6B:
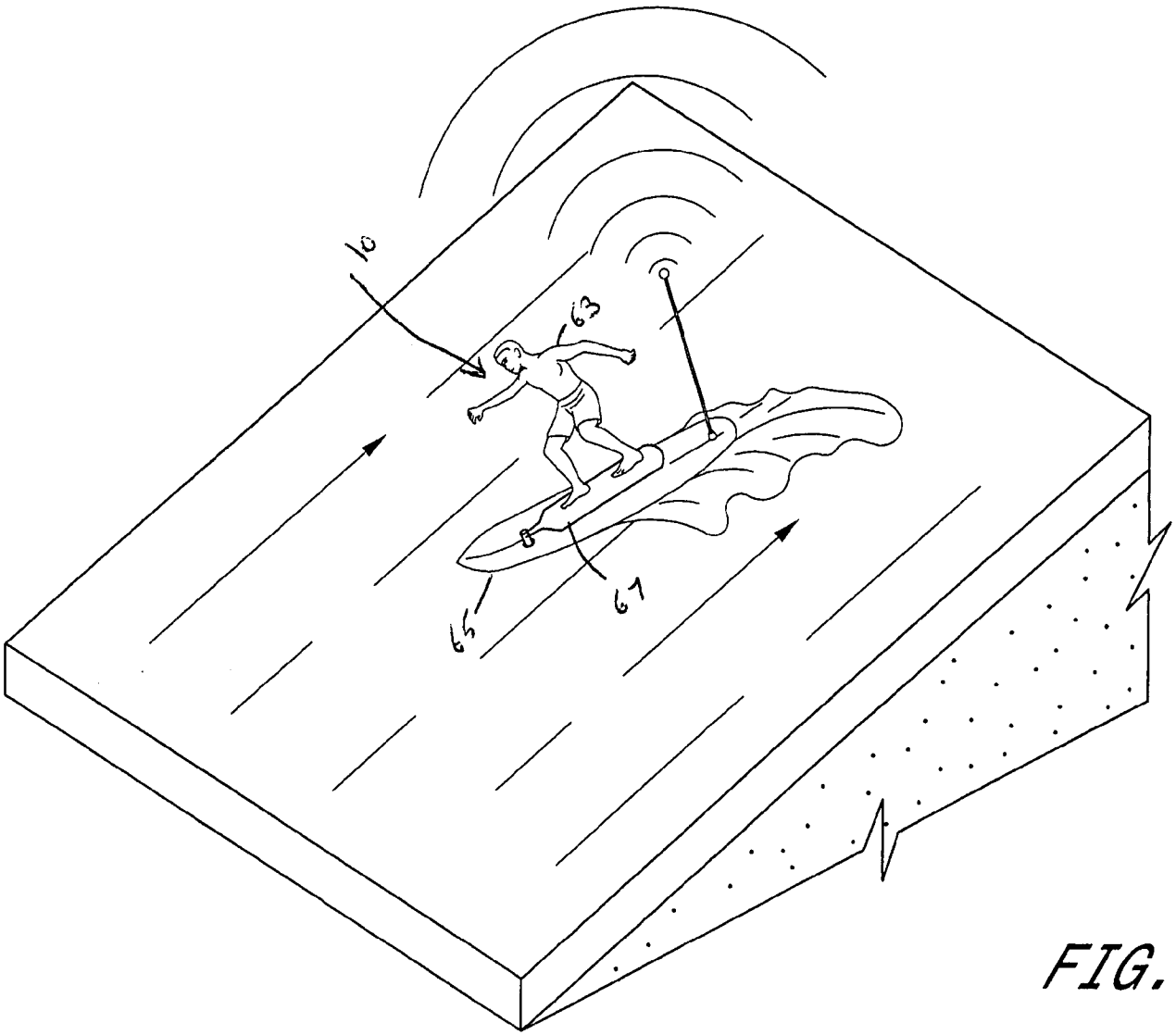
FIG. 6B is a detail view of the radio remote controlled surf toy action figure of FIG. 6A making a back-side turn.

FIG. 6B is a detail view of the radio remote controlled surf toy action FIG. 10 of FIG. 6A making a back-side turn. In this case, the base 67 of the surf action FIG. 10 is remotely actuated and rotated counter-clockwise, thereby shifting the weight of the action FIG. 63 to the back-side edge of the board 65. This induces the toy action figure to perform a back-side turning maneuver.

Figure 6C:
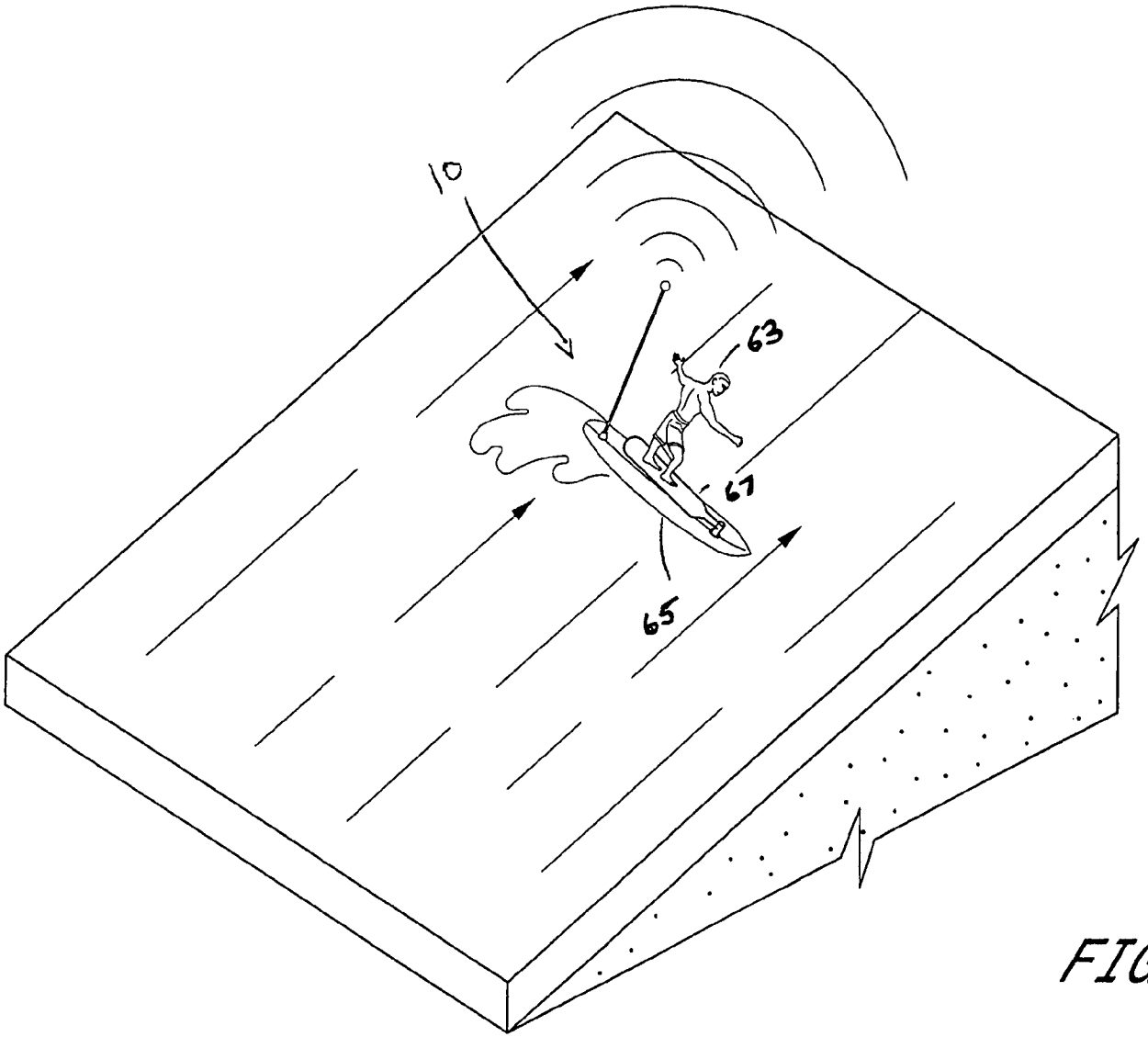
FIG. 6C is a detail view of the radio remote controlled surf toy action figure of FIG. 6A making a front-side turn.

FIG. 6C is a detail view of the radio remote controlled surf toy action FIG. 10 of FIG. 6A making a front-side turn. In this case, the base 67 of the surf action FIG. 10 is remotely actuated and rotated clockwise, thereby shifting the weight of the action FIG. 63 to the front-side edge of the board 65. This induces the toy action figure to perform a front-side turning maneuver.

Figure 7:
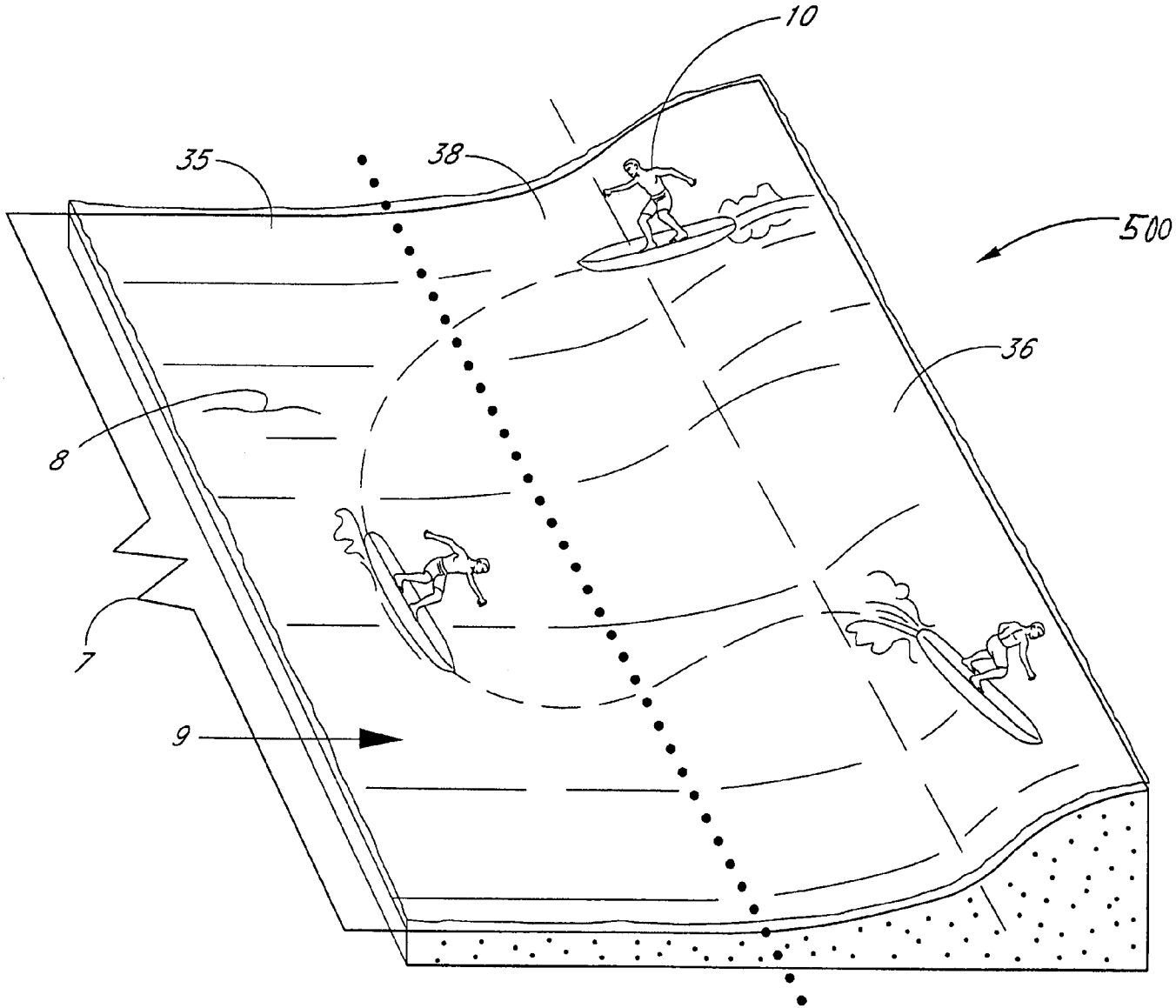
FIG. 7 is a perspective view of an alternative embodiment of a simulated surfing game apparatus having features and advantages of the present invention.

FIG. 7 is a perspective view of an alternative embodiment of a simulated surfing game apparatus 500 having features and advantages of the present invention. In particular, it may be seen that a toy surfing action FIG. 10 is caused to traverse across and perform live-action water skimming maneuvers upon an uphill sheet flow of water 8. Surf action FIG. 10 may be controlled using any one or more of the control mechanisms or methods described above and/or obvious variations thereof as will become readily apparent to those skilled in the art. Optionally, surf action FIG. 10 may be pre-programmed from among a selection of preset and/or custom maneuvers. Optionally, surf action FIG. 10 may be programmed or otherwise configured to perform random or varying surfing maneuvers. Again, many variations and modifications are possible. A game may also be played whereby play participants try to see or bet on whose surf action figure is able to stay upright on the ride surface the longest without wiping out. Multiple surf action figures of identical or varying design may be used for this purpose.

Figure 8:
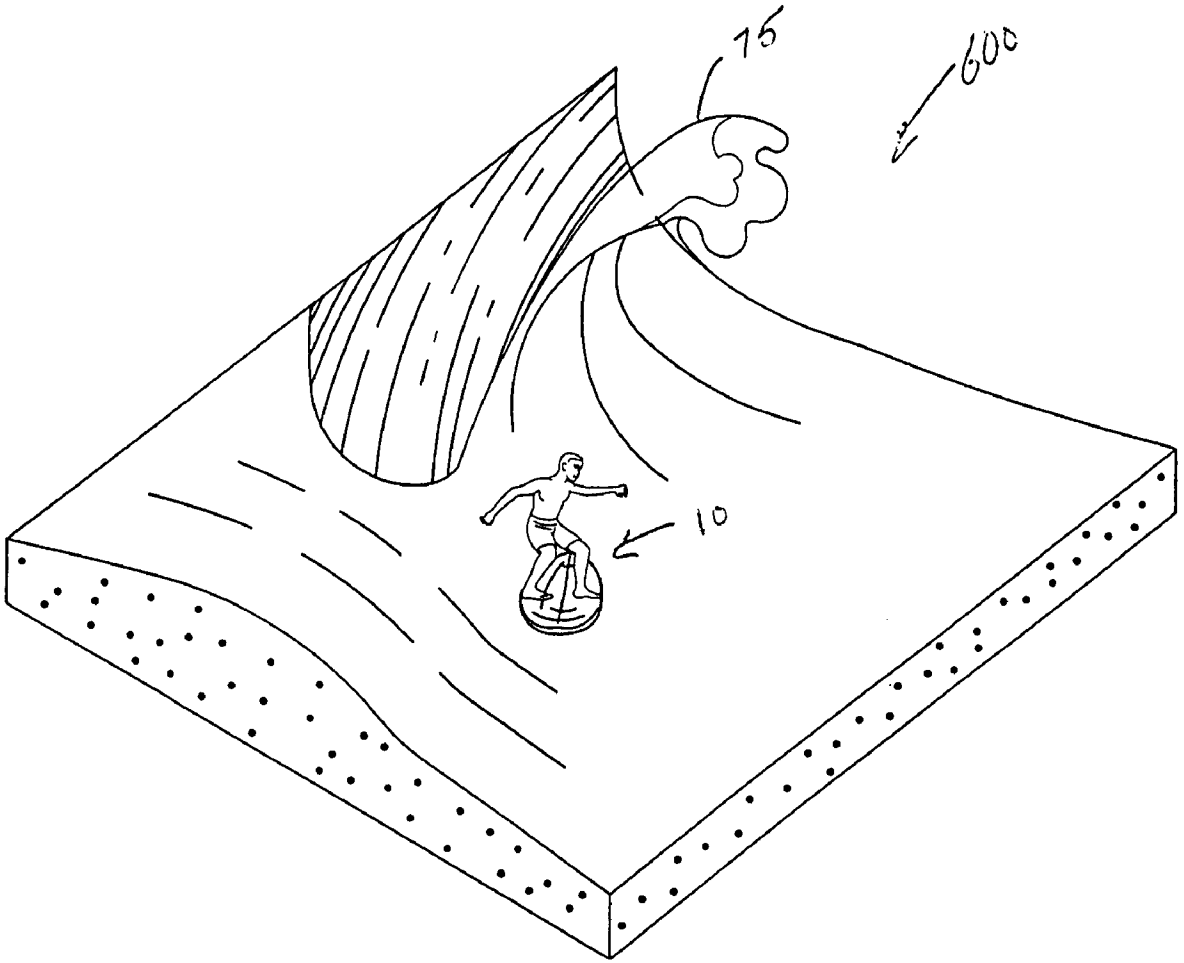
FIG. 8 is a perspective view of a further alternative embodiment of a simulated surfing game apparatus having features and advantages of the present invention.

FIG. 8 is a perspective view of a further alternative embodiment of a simulated surfing game apparatus having features and advantages of the present invention. In this case the ride surface is formed so as to create a miniature curling wave 75, as illustrated. Again, a game may be played whereby play participants try to see or bet on whose surf action FIG. 10 can stay upright and/or perform various surfing tricks (e.g., tube riding, aerials, floaters and the like) inside the curl of the wave without wiping or getting tumbled by the spilling wave 75. Multiple surf action figures of identical or varying design may be used for this purpose.

Of course, those skilled in the art will recognize that the invention may be used to achieve a wide variety of desirable wave shapes or "flow shapes" using sheet water flow over a suitably shaped forming surface. The majority of flow manifestations created by the subject invention are technically not waves. They may appear like gravity waves breaking obliquely to a beach; however, these sheet flow manifestations are distinct hydrodynamic phenomena caused by the interaction of four dynamics: (1) the subject invention's unique surface architecture; (2) the trajectory of the water relative to the flow forming surface; (3) flow separation from this surface; and (4) changes in hydraulic state of the flow (i.e., supercritical, critical or subcritical) upon this surface.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A novelty surf-action device comprising:

an inclined ride surface having a lower base portion and an upper ridge portion;

a water reservoir;

at least one nozzle at or near the ride surface;

a pump adapted to draw water from the reservoir and deliver pressurized water to the at least one nozzle, the nozzle being sized and configured to direct a flow of pressurized water onto said ride surface so that the flow of water flows up the inclined ride surface in a flow direction;

a ride figure comprising a riding vehicle adapted to ride upon and be supported by the flow of water; and a constraint member physically attached to the ride figure, the constraint member adapted to apply a constraint force to the ride figure in a direction generally opposite the flow direction so as to control a position of the ride figure relative to the ride surface as the ride figure rides upon the flow of water;

wherein the constraint member comprises a wire or string, and the wire or string exerts the constraint force on the ride figure.

2. The surf action device of claim 1, wherein the wire or string communicates with a source of the constraint force, and the constraint force source is spaced from the ride figure.

3. The surf action device of claim 2, wherein the constraint force source is provided by a play participant.

4. A novelty surf-action device comprising:

an inclined ride surface having a lower base portion and an upper ridge portion;

a water reservoir;

at least one nozzle at or near the ride surface;

a pump adapted to draw water from the reservoir and deliver pressurized water to the at least one nozzle, the nozzle being sized and configured to direct a flow of pressurized water onto said ride surface so that the flow of water flows up the inclined ride surface in a flow direction;

a ride figure comprising a riding vehicle adapted to ride upon and be supported by the flow of water; and a constraint member physically attached to the ride figure, the constraint member adapted to apply a constraint force to the ride figure in a direction generally opposite the flow direction so as to control a position of the ride figure relative to the ride surface as the ride figure rides upon the flow of water;

wherein the constraint member comprises an elongate member attached to the ride figure, and the constraint force is communicated along the elongate member.

5. The surf action device of claim 4, wherein the constraint member applies a constraint force to the ride figure sufficient to maintain the ride figure in a stable riding position upon the ride surface.

6. The surf action device of claim 4, wherein the elongate member communicates with a source of the constraint force, and the constraint force source is spaced from the ride figure.

7. The surf action device of claim 6, wherein the constraint force source is provided by a play participant.

8. A novelty surf-action device comprising:

an inclined ride surface having a lower base portion and an upper ridge portion;

a water reservoir;

at least one nozzle at or near the ride surface;

a pump adapted to draw water from the reservoir and deliver pressurized water to the at least one nozzle, the nozzle being sized and configured to direct a flow of pressurized water onto said ride surface so that the flow of water flows up the inclined ride surface;

a ride figure comprising a riding vehicle adapted to ride upon and be supported by the flow of water; and a magnet coupled to the ride figure, the magnet adapted to control a position of the ride figure relative to the ride surface as the ride figure rides upon the flow of water.

9. The surf action device of claim 8, wherein the magnet is movable relative to the ride surface so as to move the ride figure relative to the ride surface.

10. A surf action device, comprising:

an inclined ride surface having a lower base portion and an upper ridge portion;

a nozzle disposed at or near the ride surface, the nozzle adapted to be attached to a source of pressurized water so as to deploy a flow of water configured to flow up the inclined ride surface in a flow direction generally from the lower base portion to the upper ridge portion;

a ride figure comprising a riding vehicle adapted to ride upon and be supported by the flow of water; and a control mechanism adapted to selectively turn the ride figure so as to control an attitude of the ride figure relative to the ride surface and the flow of water; and a remote controller adapted to control the control mechanism from a location spaced from the ride figure;

wherein the ride figure is configured so that substantially all momentum in a direction opposite to the flow direction is obtained by positioning the ride figure upon the inclined ride surface so that gravitational forces overcome forces applied by the flow of water in the flow direction.

11. The surf action device of claim 10, wherein said control mechanism comprises a movable weight disposed on the ride figure.

12. The surf action device of claim 11, wherein said control mechanism comprises a radio controller adapted to control the position of the movable weight on the ride figure.

13. The surf action device of claim 12, characterized in that the ride figure has no propellant system for propelling the ride figure in a desired direction independent of external forces.

* * * * *